United States Patent [19]

Lappin, Jr.

[11] 3,985,143

[45] Oct. 12, 1976

[54] SELF EXTINGUISHING CIGARETTE

[76] Inventor: James B. Lappin, Jr., 751 Main St., South Portland, Maine 04106

[22] Filed: Feb. 21, 1975

[21] Appl. No.: 551,537

[52] U.S. Cl. ..... 131/4 A
[51] Int. Cl.[2] ..... A24D 1/10
[58] Field of Search ..... 131/4 A, 10.1, 12, 13, 131/17 R

[56] References Cited

UNITED STATES PATENTS

| | | | |
|---|---|---|---|
| 1,726,737 | 9/1929 | Harris | 131/4 A |
| 3,884,246 | 5/1975 | Walker | 131/10.1 |

FOREIGN PATENTS OR APPLICATIONS

| | | | |
|---|---|---|---|
| 1,204,018 | 9/1970 | United Kingdom | 131/10.1 |
| 835,923 | 5/1960 | United Kingdom | 131/4 A |

*Primary Examiner*—Robert W. Michell
*Assistant Examiner*—V. Millin
*Attorney, Agent, or Firm*—C. Yardley Chittick

[57] ABSTRACT

Means for automatically extinguishing a cigarette when it has burned to a pre-determined position along its length. The means comprises a small sack of liquid, ordinarily water, positioned at the required location within the tobacco and the paper tube. The sack will be ruptured by the advancing heat of the burning tobacco and the released water will be in sufficient quantity to quench the flame.

1 Claim, 7 Drawing Figures

SELF EXTINGUISHING CIGARETTE

BRIEF SUMMARY OF THE INVENTION

The invention resides in the inclusion in a conventional cigarette of means for extinguishing the cigarette when the burning tobacco has reached a pre-determined position along the length of the cigarette. Ordinarily this will be in the vicinity of a position at which a smoker would normally extinguish his cigarette with perhaps one quarter to one third unconsumed. The means for extinguishing the cigarette is a small sack or container of water placed within the paper tube at the selected location. The container will be ruptured by the heat or flame of the burning tobacco and upon rupture of the container the water therein will instantly spread through the tobacco to extinguish the flame.

The container is preferably made of a very thin film of plastic which is currently available on the market. The container may assume any of a number of selected forms but in each case the transverse area of the container will be such that the smoke drawn by the user through the cigarette will not be appreciably impeded.

The material forming the container is preferably under tension so that when it is ruptured the water therein will be completely released to instantly saturate the tobacco at that location.

It is recognized that earlier attempts at providing means for causing automatic extinguishing of cigarettes have been made, but as far as I am aware these devices because of inherent deficiencies have never come into use. As illustrative of earlier patents in this field, reference is made to Seney U.S. Pat. No. 2,246,929, Henderson U.S. Pat. No. 2,547,119, Lattof U.S. Pat. No. 2,666,437, and Weinberger U.S. Pat. No. 1,999,222.

DETAILED DESCRIPTION OF A PREFERRED EMBODIMENT OF THE INVENTION

Figure 1:
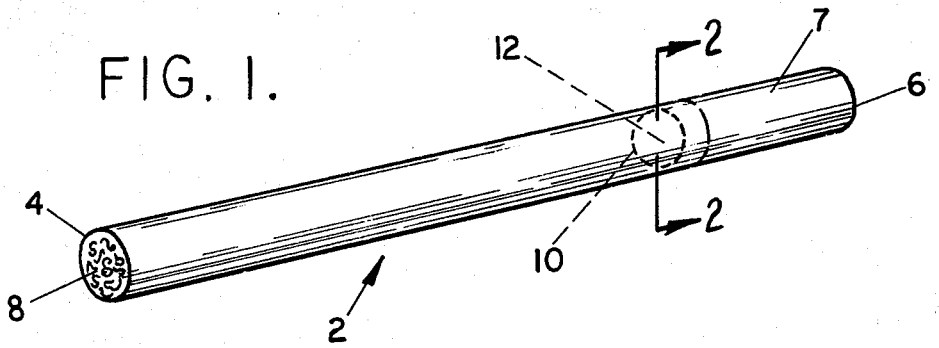
FIG. 1 shows a conventional cigarette having the extinguishing means located therein toward the unlighted end.

Referring first to FIG. 1, there is shown a conventional cigarette 2, with the lighted end at 4, and the rear end at 6. A filter may or may not be present according to the type of cigarette being sold.

The cigarette is made in a conventional manner and contains therein tobacco 8. At any selected position in the length of the cigarette normally perhaps ⅔'s to ¾'s of the way toward the rear end 6, or adjacent to the filter if there is one, there is located in the tobacco, a small container having therein water 12. It will be understood that the container 10 may be made of any suitable material adapted to hold the liquid and which is capable of being ruptured by the heat of the advancing burning tobacco. While water is the preferred liquid to be used, any other liquid capable of dampening or affecting the tobacco sufficiently to extinguish the combustion may be used.

Figure 2:
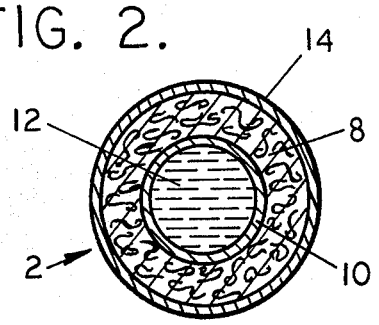
FIG. 2 is a section taken on the line 2—2 of FIG. 1 in which the container is in the form of a sphere.

FIG. 2 which is a section taken of the line 2—2 of FIG. 1, shows the outer paper of the cigarette at 14, the tobacco at 8, and a pellet or container 10 filled with water 12. The container 10 will ordinarily and preferably be made of a thin film of polyethelyne, rubber, neoprene or other material of similar water proof and preferably stretchable characteristics. The individual water filled containers may be made through the use of known machines such as are used in the pharmaceutical industry for the creation of liquid filled pellets.

Figure 3:
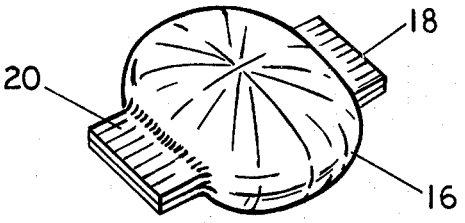
FIG. 3 is a modified form of container.

FIG. 3 is illustrative of a modified form of pellet in which the body 16, originally in the form of a tube filled with water, has its ends closed and crimped at 18 and 20.

Figure 4:
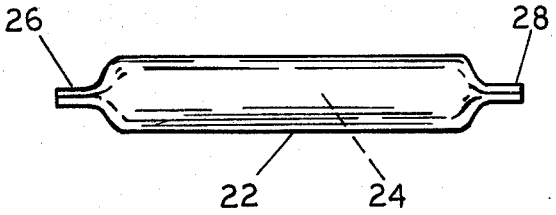
FIG. 4 is still another modification showing the container in the form of a relatively long tubular unit.

In the construction shown in FIG. 4, the pellet is in the form of a small diameter elongated tube 22, filled with water 24 and sealed by crimping at both ends as at 26 and 28.

Figure 5:
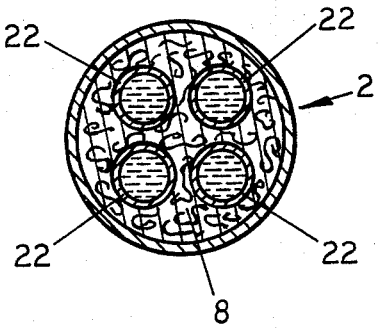
FIG. 5 is a cross section of a cigarette showing therein a plurality of the units shown in FIG. 4.

FIG. 5 illustrates the manner in which a plurality of the units 22 may be located in parallel relation within the tobacco 8 of the cigarette at the location at which the combustion is to be extinguished. By having the tubes elongated in this manner an increased amount of water may be made available for extinguishing the cigarette without adversely affecting the passage of the smoke. Of course it will be understood that a single unit 22, of large diameter could be used instead of the multiplicity shown in FIG. 5.

Figure 6:
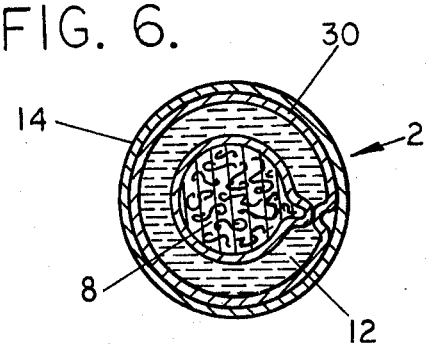
FIG. 6 is a cross section of a cigarette showing the container therein in the form of a ring with tobacco in the center thereof.

The modification shown in FIG. 6 is illustrative of an arrangement in which the water when released from the container will work inwardly to wet the tobacco within the donut-like container 30, instead of working radially outward as illustrated in FIG. 2. In FIG. 6 the container 30 is in the form of a tube sealed at both ends and then formed into a ring of such diameter that it will fit snugly and unobstrusively within the cylindrical cigarette paper 14. When the container is ruptured by the heat of the advancing burning tobacco, the released water 12 will be adequate to saturate the tobacco 8 sufficiently to extinguish the flame.

Figure 7:
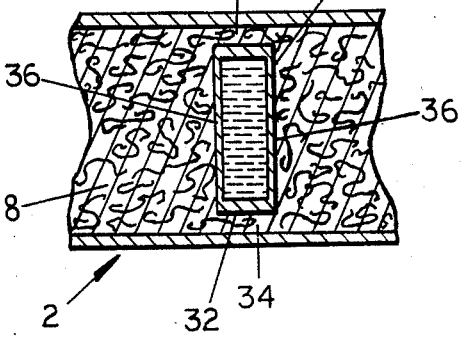
FIG. 7 is a longitudinal section of a portion of a cigarette in which the container is in the form of a hollow circular disc having the circumferencial portion and the faces of materials of unequal strength.

FIG. 7 illustrates still another form of container 31 which is in the nature of a very short cylindrical tube. The outer wall of the tube shown at 32 is of such diameter as to allow adequate clearance at 34 for the passage of smoke. The faces 36 of the tube are of thinner and more delicate material than the circumference portion 32 so that when the faces 36 are ruptured, there will be substantially complete disintegration allowing all of the water to immediately saturate the adjacent tobacco.

While a number of modifications of water-filled pellet have been disclosed herein, it will be understood that the invention is not limited thereto but encompasses any form of water-filled pellet in which the container material is capable of being ruptured by the advancing burning tobacco, or is capable of being ruptured by the heat created by the advancing burning tobacco and at the same time, its cross-sectional area will not adversely affect the passage of smoke thereby as the cigarette is being smoked by the user.

The location of the extinguishing means will preferably be far enough in advance of the rear end to minimize the amount of undesirable substances such as nicotine and tars being drawn into the users mouth and lungs prior to the cigarette being extinguished. Also, the water-filled pellet may be located in or just in advance of the filter if it is desired to maximize the amount of tobacco to be burned before extinguishing the cigarette.

When the term water is used in the claims, it is to be understood that this represents any type of liquid capable of extinguishing the combustion.

When the term plastic is used in the claims as representing the material of the liquid container, it is to be understood that this is representative of any suitable waterproof material adapted to hold the liquid and to be ruptured by the advancing burning tobacco.

I claim:

1. In a cigarette comprised of a combustible tube with tobacco therein, means for extinguishing the cigarette when the burning tobacco has advanced to a predetermined location toward the rear end thereof, said means comprising a unitary water filled circular container positioned within said cigarette, said container being in the form of a disc having a peripheral wall and two spaced faces with its axis extending longitudinally of the cigarette and with said peripheral wall paralleling and spaced from the interior of said tube the diameter of said container being greater than its longitudinal dimension and the cross sectional area of said container taken at right angles to said axis being greater than the remaining cross sectional area within the tube through which the smoke passes, said container being made of material capable of being ruptured by the heat of the burning tobacco as it reaches said container, said container wall being of one thickness of said material and the said face of said disc that is remote from the rear end of said cigarette being of thinner and more delicate material that is more susceptible to heat from the advancing burning tobacco than the said one thickness of said material forming the said wall, the said remaining cross sectional area through which the smoke passes being less impeded by tobacco than the body of the cigarette whereby when the user draws normally on said lighted cigarette, there will be adequate flow of smoke past said container.

* * * * *